US011619454B2

(12) United States Patent
Hussein et al.

(10) Patent No.: US 11,619,454 B2
(45) Date of Patent: Apr. 4, 2023

(54) HEAT EXCHANGER

(71) Applicant: HIETA TECHNOLOGIES LIMITED, Bristol (GB)

(72) Inventors: Ahmed Hussein, Bristol (GB); Javier Viñuales Navarro, Bristol (GB)

(73) Assignee: HIETA TECHNOLOGIES LIMITED, Bristol (GB)

( * ) Notice: Subject to any disclaimer, the term of this patent is extended or adjusted under 35 U.S.C. 154(b) by 412 days.

(21) Appl. No.: 16/634,691

(22) PCT Filed: Aug. 1, 2018

(86) PCT No.: PCT/GB2018/052194

§ 371 (c)(1),
(2) Date: Jan. 28, 2020

(87) PCT Pub. No.: WO2019/025793

PCT Pub. Date: Feb. 7, 2019

(65) Prior Publication Data

US 2021/0080194 A1 Mar. 18, 2021

(30) Foreign Application Priority Data

Aug. 4, 2017 (GB) ..... 1712575

(51) Int. Cl.
*F28F 13/12* (2006.01)
*F28F 1/08* (2006.01)
(Continued)

(52) U.S. Cl.
CPC ..... *F28F 1/08* (2013.01); *B21D 53/06* (2013.01); *F01N 5/02* (2013.01); *F28F 13/06* (2013.01); *F28F 13/12* (2013.01)

(58) Field of Classification Search
CPC ..... F28F 1/08; F28F 1/40; F28F 13/06; F28F 13/12
See application file for complete search history.

(56) References Cited

U.S. PATENT DOCUMENTS 3,372,743 A 3/1968 Pall et al.
4,781,248 A 11/1988 Pfeiffer
(Continued)

FOREIGN PATENT DOCUMENTS

EP 0 014 066 8/1980
EP 1 688 692 8/2006
(Continued)

OTHER PUBLICATIONS

International Search Report and Written Opinion of the ISA for PCT/GB2018/052194, dated Oct. 23, 2018, 15 pages.
(Continued)

*Primary Examiner* — Eric S Ruppert
(74) *Attorney, Agent, or Firm* — Nixon & Vanderhye P.C.

(57) ABSTRACT

A heat exchanger (4) has fluid flow channels (6) with at least one heat exchanging surface (10) which has an undulating surface section for which the surface profile varies along a predetermined direction such that at a first edge (E1) the surface profile follows a first transverse wave (20), at a second edge (E)2 the surface profile follows a second transverse wave (22) and at an intermediate point I between the edges the surface profile follows a third transverse wave (24). The third transverse wave (24) has a different phase, frequency or amplitude to the first and second transverse waves so that chevron-shaped ridges and valleys are formed. This improves the mixing of fluid passing through the channel and hence the heat exchange efficiency.

21 Claims, 13 Drawing Sheets

(51) Int. Cl.

| | |
|---|---|
| ***B21D 53/06*** | (2006.01) |
| ***F01N 5/02*** | (2006.01) |
| ***F28F 13/06*** | (2006.01) |

(56) References Cited

U.S. PATENT DOCUMENTS

| | | | | |
|---|---|---|---|---|
| 2006/0289152 | A1 | 12/2006 | Leuschner et al. | |
| 2010/0139631 | A1* | 6/2010 | Geskes ..... | F28F 13/02 165/181 |
| 2015/0099453 | A1 | 4/2015 | Eleftheriou et al. | |
| 2016/0305720 | A1 | 10/2016 | Rhee et al. | |

FOREIGN PATENT DOCUMENTS

| | | |
|---|---|---|
| EP | 2 787 316 | 10/2014 |
| JP | S46-003389 | 2/1971 |
| JP | S54-079048 | 6/1979 |
| WO | 2005/036086 | 4/2005 |
| WO | 2007/012874 | 2/2007 |
| WO | 2015/082348 | 6/2015 |
| WO | 2017/033306 | 2/2017 |

OTHER PUBLICATIONS

Search Report for GB1712575.8, dated Jan. 23, 2018, 4 pages.
Office Action for JP Application No. 2020-505172 dated Jul. 15, 2022 and English translation, 10 pages.

* cited by examiner

HEAT EXCHANGER

This application is the U.S. national phase of International Application No. PCT/GB2018/052194 filed 1 Aug. 2018, which designated the U.S. and claims priority to GB Patent Application No. 1712575.8 filed 4 Aug. 2017, the entire contents of each of which are hereby incorporated by reference.

The present technique relates to the field of heat exchangers.

A heat exchanger may include a number of fluid flow channels through which fluid can flow so that heat may be exchanged by the fluid in respective channels of the heat exchanger. Heat exchangers can be useful for a range of applications, for example as a recuperator for recovering heat from exhaust gas from an internal combustion engine or gas turbine, or in other applications such as power generation or ventilation systems.

At least examples provide a heat exchanger comprising: a plurality of fluid flow channels; at least one of the fluid flow channels comprising at least one heat exchanging surface comprising at least one undulating surface section extending along at least part of a length of the channel, wherein the at least one heat exchanging surface comprises a secondary surface of the heat exchanger; wherein for each undulating surface section: along a first edge of the undulating surface section aligned with a predetermined direction, a profile of the heat exchanging surface varies according to a first transverse wave with a direction of travel corresponding to the predetermined direction; along a second edge of the undulating surface section aligned with the predetermined direction, a profile of the heat exchanging surface varies according to a second transverse wave with a direction of travel corresponding to the predetermined direction; and at an intermediate portion of the undulating surface section lying between the first edge and the second edge, a profile of the heat exchanging surface varies according to a third transverse wave with a direction of travel corresponding to the predetermined direction; wherein said third transverse wave has at least one of different phase, different amplitude and different frequency to at least one of said first transverse wave and said second transverse wave, to provide one or more chevron-shaped ridges or valleys in the undulating surface section.

At least some examples provide a method of manufacturing a heat exchanger comprising: forming a plurality of fluid flow channels; at least one of the fluid flow channels comprising at least one heat exchanging surface comprising at least one undulating surface section extending along at least part of a length of the channel, wherein the at least one heat exchanging surface comprises a secondary surface of the heat exchanger; wherein for each undulating surface section: along a first edge of the undulating surface section aligned with a predetermined direction, a profile of the heat exchanging surface varies according to a first transverse wave with a direction of travel corresponding to the predetermined direction; along a second edge of the undulating surface section aligned with the predetermined direction, a profile of the heat exchanging surface varies according to a second transverse wave with a direction of travel corresponding to the predetermined direction; and at an intermediate portion of the undulating surface section lying between the first edge and the second edge, a profile of the heat exchanging surface varies according to a third transverse wave with a direction of travel corresponding to the predetermined direction; wherein said third transverse wave has at least one of different phase, different amplitude and different frequency to at least one of said first transverse wave and said second transverse wave, to provide one or more chevron-shaped ridges or valleys in the undulating surface section.

At least examples provide a system comprising a combustor to generate heat by combusting a fuel, and a recuperator to recover heat from the exhaust gas output by the combustor, where the recuperator comprises of the heat exchanger as discussed above.

At least some examples provide a computer-readable data structure representing a design of a heat exchanger as discussed above. The data structure may be stored on the storage medium. The storage medium may be a non-transitory storage medium.

Further aspects, features and advantages of the present technique will be apparent from the following description of examples, which is to be read in conjunction with the accompanying drawings, in which:

FIG. 1 schematically illustrates an example of a heat exchanger used as a recuperator in a combined heat and power (CHP) system;

Figure 3:
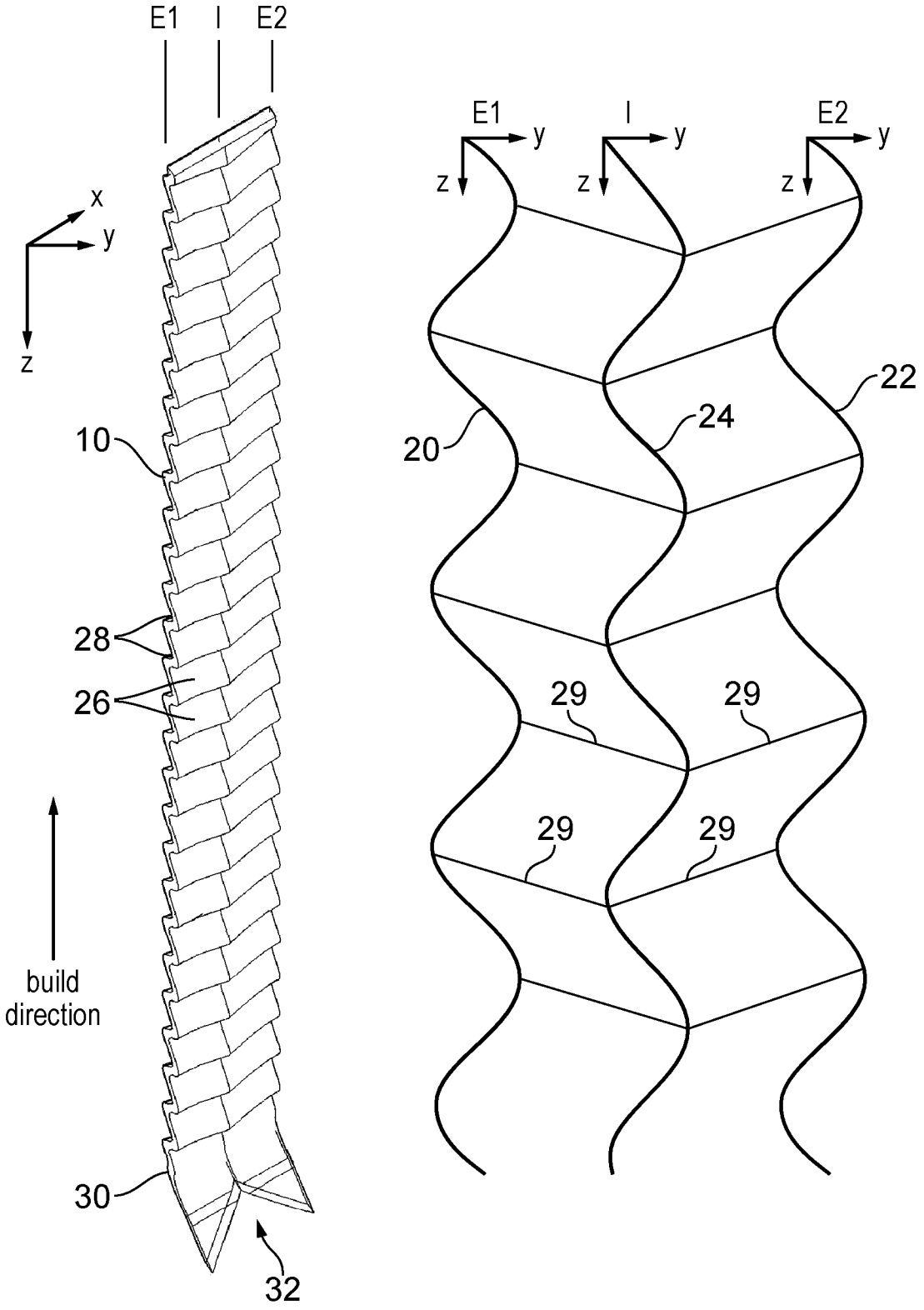
FIG. 3 shows an example of a heat exchanging surface for one of the fluid flow channels of the heat exchanger, which comprises an undulating surface section.
Figure 12:
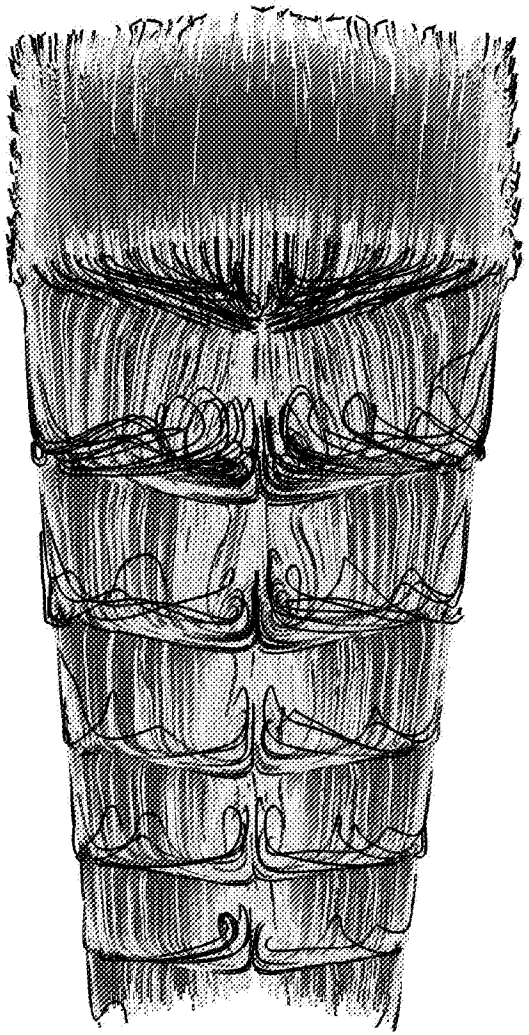
Figure 12:
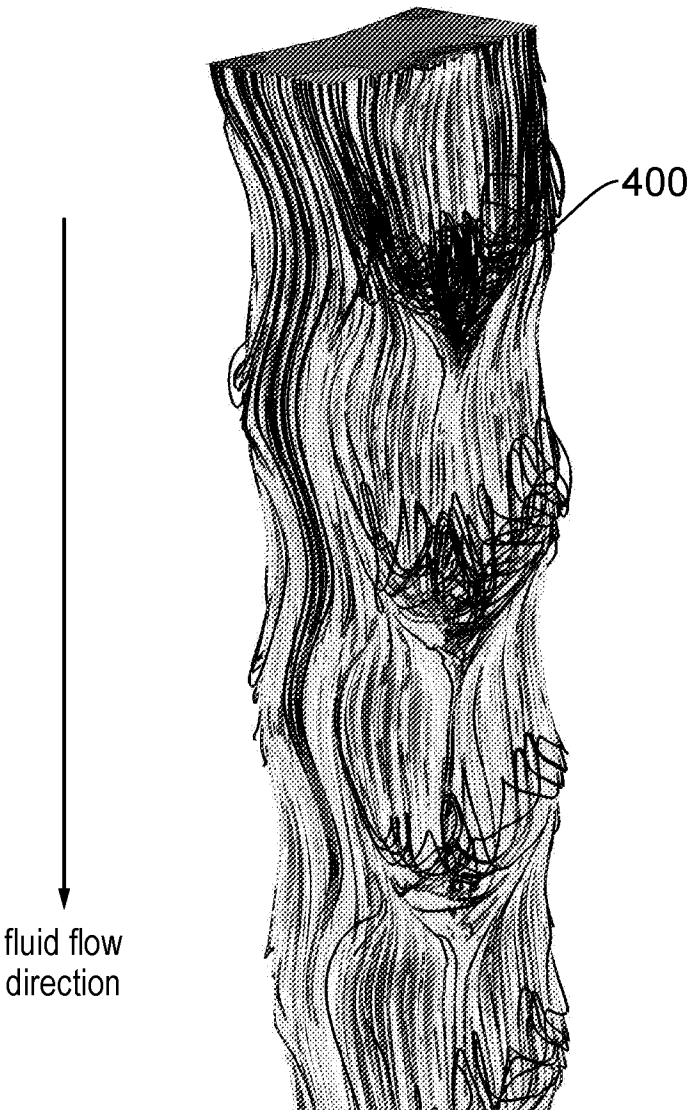
Figure 13:
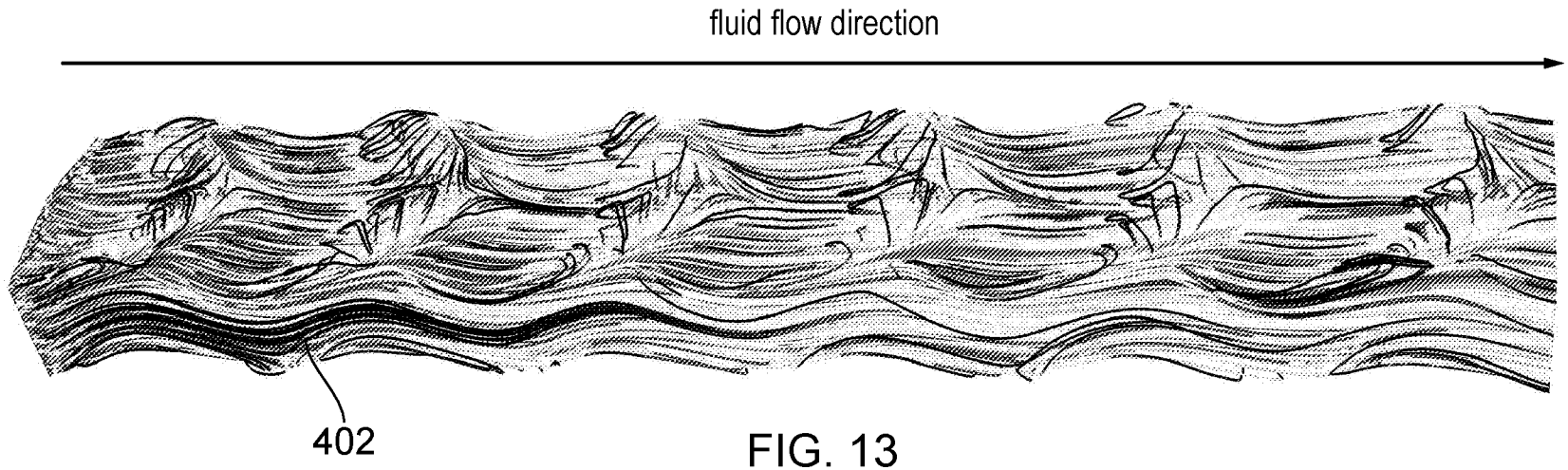
Figure 14:
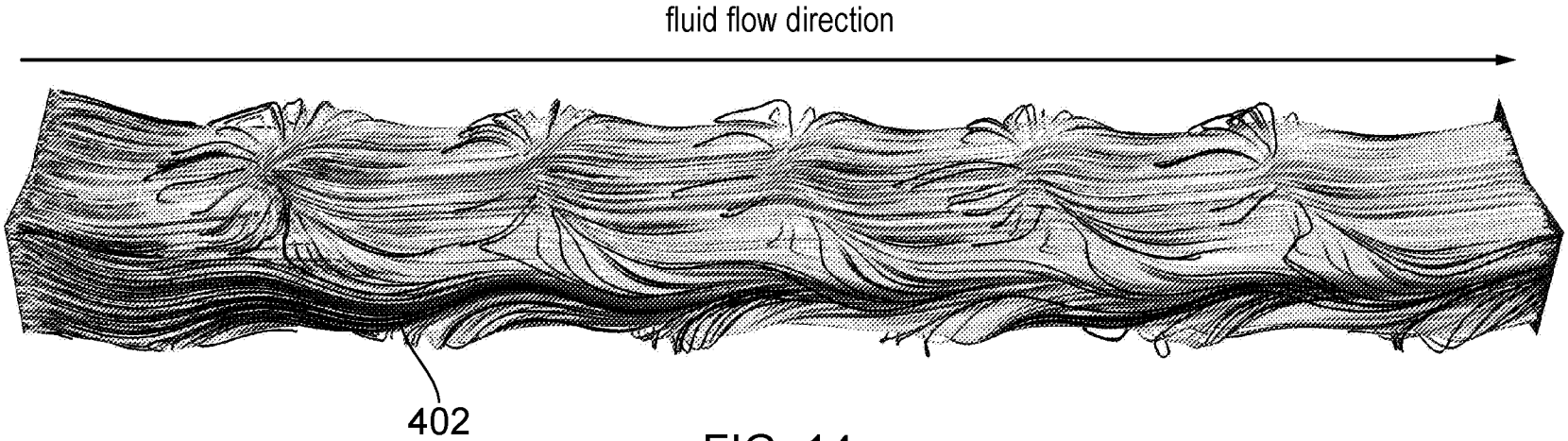

FIGS. 12 and 13 show velocity streamline diagrams obtained by a computational fluid dynamics (CFD) simulation of fluid flow through a channel having a heat exchanging surface as shown in FIG. 3, with FIG. 12 showing top and front views and FIG. 13 showing a side view; and FIG. 14 shows, for comparison, a velocity streamline diagram obtained by CFD in a case where the fluid flows through the channel in the opposite direction to the direction shown in FIGS. 12 and 13.

A heat exchanger has a number of fluid flow channels. Fluid can flow through the channels and exchange heat with fluid flowing through neighbouring channels. In some examples, the heat exchanger may comprise alternating channels for flow of the first and the second fluid so that the first and second fluids may exchange heat. However, there may be tendency for fluid flowing through a given channel to stick to the walls of the channel so that there may not be a significant amount of mixing between the fluid adjacent to the walls of the channel and fluid at the centre of the channel further from the walls. This can reduce the effectiveness of the heat exchanger as there is less opportunity for the fluid in the centre of the channel to exchange heat through the boundaries of the channel with the fluid in neighbouring channels.

In the heat exchanger described below, at least one of the fluid flow channels includes at least one heat exchanging surface which has at least one undulating surface section extending along at least part of a length of the channel. For each undulating surface section, along a first edge of the undulating surface section aligned with a predetermined direction, a profile of the heat exchanging surface varies according to a first transverse wave with a direction of travel corresponding to a predetermined direction; along a second edge of the undulating surface section aligned with the predetermined direction, a profile of the heat exchanging surface varies according to a second transverse wave with a direction of travel corresponding to the predetermined direction; and at an intermediate portion of the undulating surface section lying between the first edge and the second edge, a profile of the heat exchanging surface varies according to a third transverse wave with a direction of travel corresponding to the predetermined direction. The third transverse wave has at least one of different phase, different amplitude and different frequency to at least one of the first transverse wave and the second transverse wave, to provide one or more chevron-shaped ridges or valleys in the undulating surface section.

Hence, the undulating surface section has a wavy surface profile and the wave at an intermediate portion of the undulating surface section has at least one of different phase, different amplitude and different frequency to at least one of the first and second transverse waves at the edges of the undulating surface section. This means that one or more chevron-shaped ridges or valleys are provided in the undulating surface section. These chevron-shaped ridges and valleys help to guide the fluid flow away from the heat exchanging surface and promote mixing of the fluid within the fluid flow channel, so that it is less likely that a certain volume of fluid stays at the centre of the channel all the way along the length of the channel. The heat transfer is enhanced because the flow passes over the concave surfaces of the valleys to form counter-rotating vortices on the respective sides of the apex of the chevron-shapes, which generates local zones of flow separation and re-attachment. Unlike a surface where the profile of the surface follows the same wave profile all the way across the surface in the direction perpendicular to the predetermined direction, by making the third transverse wave have a different form to the first and third transverse waves and forming the chevron-shaped ridges and valleys, lower pressure drop can be achieved and the efficiency of heat exchange improved. While making a surface with such a wavy profile can be challenging using conventional means such as casting or moulding, by using additive manufacture it is possible to manufacture intricately patterned surfaces. Hence, a heat exchanger with at least one channel having the undulating surface section as discussed above provides better heat exchange properties, and is practical to manufacture.

In some examples the first and second transverse waves may have different phase, different amplitude and/or different frequency. This provides a high degree of freedom in controlling the surface profile of the undulating surface section.

However, in other examples the first transverse wave may have the same phase, amplitude and frequency as the second transverse wave. Hence, the surface profile at the edges of the undulating surface section may vary in the same manner along the predetermined direction, but there is a different transverse wave pattern of variation of the surface profile at the intermediate portion.

In one example the third transverse wave may be out of phase with at least one of the first transverse wave and the second transverse wave. Hence, the apex of the chevron-shaped ridges or valleys occurs at a different position along the predetermined direction at the intermediate portion of the undulating surface section than at the edges. This results in chevron-shaped ridges which point in the predetermined direction or in the opposite direction to the predetermined direction, which has been found to be an effective surface profile for promoting cyclic re-circulation patterns to promote mixing of fluid.

In another example the third transverse wave may have a different frequency to at least one of the first and second transverse waves. Hence, the surface may have a greater or smaller number of ridges or valleys at the centre of the undulating surface section compared to the edges.

In another example the third transverse wave may have a different amplitude to at least one of the first and second transverse waves. Hence, the difference between the depth of the valleys and height of the ridges at the intermediate portion of the undulating surface section can be greater or smaller than the difference between the ridge height and valley depth at the edges of the undulating surface section. Again, this results in chevron-shaped ridges and valleys extending across the undulating surface section which helps to promote the mixing of fluid.

In some examples each of the first, second and third transverse waves may have the same waveform. However it is also possible for the third transverse wave to have a different waveform to at least one of the first and second transverse waves. A number of different waveforms could be used, but particularly useful waveforms may include a sinusoidal wave or a triangle wave. Sinusoidal or triangle waves are useful they avoid sharp changes in level which makes it easier to manufacture the undulating surface section through additive manufacturing techniques (as additive manufacture may impose a limitation that it is not possible for an upper layer to be built on a lower layer of material if the upper layer overhangs by more than a certain threshold angle). Nevertheless, other waveforms could also be used. The waveforms of the first, second and third transverse waves need not be regular, e.g. they could be superposition of a set of harmonics or components. For example in some cases the first, second or third transverse waves may include waveforms which have the period from one peak to the next trough different to the period from one trough to the next peak, or which have multiple peaks/troughs per cycle at irregular intervals within the cycle.

In some examples an apex of the chevron-shaped ridges or values lies halfway between the first edge and the second edge. Hence, the chevrons may be symmetrical so that there are equal sized portions of the chevron on either side of the apex at the midpoint of the first and second edges. Alternatively, at least one of the chevron-shaped ridges or valleys may have an apex lying closer to one of the first edge and the second edge than the other. In this case the chevrons may be asymmetric as the portion on one side of the apex may be larger than the portion on the other.

Some fluid flow channels may have a single undulating surface section as discussed above, disposed across the width of the channel. However it is also possible for multiple such undulating surface sections to be disposed side by side within the heat exchanging surface, with the first edge of one undulating surface section adjacent to the second edge of another undulation surface section. In this case the chevron-shaped ridges of the adjacent undulating surface sections could join up to form a W-shaped ridge or a zigzag-shaped ridge. Alternatively, the chevrons of adjacent undulating surface sections may be out of phase with one another, in which case a number of distinct chevrons may be provided going across the undulating surface section in a direction orthogonal to the predetermined direction, with the chevrons not linking up in adjacent undulating surface sections as they are disposed at different locations along the predetermined direction for different undulating surface sections within the heat exchanging surface.

The at least one heat exchanging surface may have a substantially constant thickness in the at least one undulating surface section. Hence, even though the surface profile of the undulating surface section varies in the wave pattern discussed above, the thickness still remains the same (within bounds of manufacturing tolerance) regardless of the point of the wave at which are given point on the surfaces located. This can be useful for ensuring a consistent thermal conductance across the undulating surface so that the wave like surface of the heat exchanger surface provided to promote fluid mixing does not compromise the ability to conduct heat through the walls of the channel.

In some cases, the undulating heat exchanging surface may comprise the wall of the fluid flow channel in which the heat exchanging surface is provided. Alternatively, the heat exchanging surface could be an internal fin which partially sub-divides a given fluid flow channel. The internal fins need not pass along the entire length of the heat exchanging channel. Instead the internal fin may extend along less than a full length of the heat exchanging channel in the predetermined direction. If multiple fins are provided then these could be placed at offset locations along the length of the channel, with gaps in-between. In some cases the lateral positions of the internal fins in the channel in a direction orthogonal to the predetermined direction could be offset or staggered.

The predetermined direction corresponds to the direction of fluid flow of fluid through the fluid flow channels. For example the fluid flow direction may correspond to the long axis of the fluid flow channels. Note that the fluid flow channels could in some embodiments correspond to straight channels, but could also be bent or follow a tortuous path or a path bending around a turn, and so in some cases the fluid flow direction may not be straight but may follow a curved path. In this case the first, second and third transverse waves may also follow the curve path. By orienting the first, second and third transverse waves such that they have a direction of travel that corresponds to the fluid flow direction, this provides greater heat exchanger efficiency as this means that the fluid passing through the channels alternates across the chevron-shaped ridges and valleys in the undulating surface section and this promotes re-circulation of the fluid at periodic intervals along the channel length making it less likely that a given volume of fluid remains far from any surface by which heat can be conducted to fluid in adjacent channels.

The heat exchanger may comprise of an integrated mass of consolidated material, for example made by additive manufacture. This contrasts with heat exchangers where the respective channels are manufactured from a number of separate components. Hence, the fluid flow channels, including at least one heat exchanging surface having the undulating surface section, may be formed together as one entity from a single body of material.

The heat exchanger described above can be used in a range of engineering systems. However it can be particularly useful for a system comprising a combustor for generating heat by combusting a fuel and a recuperator for recovering heat from exhaust gas output by the combustor. The recuperator may comprise the heat exchanger as discussed above. Compactness can often be an important requirement for such systems. By improving the heat exchanger efficiency, the heat exchanger can often be made smaller as shorter channels may be sufficient to provide a given amount of heat exchange.

For example the heat exchanger can be formed by additive manufacture. In additive manufacture, an article may be manufactured by successively building up layer after layer of material in order to produce an entire article. For example the additive manufacture could be by selective laser melting, selective laser centring, electron beam melting, etc. The material used for the heat exchanger can vary, but in some examples may be a metal, for example aluminium, titanium or steel or could be an alloy. In some cases the heat exchanger may be formed in one single process whereby the layers making up the respective parts of the heat exchanger may be laid down successfully by additive manufacture.

The additive manufacture process may be controlled by supplying an electronic design file which represents characteristics of the design to be manufactured, and inputting the design file to a computer which translates the design file into instructions supplied to the manufacturing device. For example, the computer may slice a three-dimensional design into successive two-dimensional layers, and instructions representing each layer may be supplied to the additive manufacture machine, e.g. to control scanning of a laser across a powder bed to form the corresponding layer. Hence, in some embodiments rather than providing a physical heat exchanger, the technique could also be implemented in a computer-readable data structure (e.g. a computer automated design (CAD) file) which represents the design of a heat exchanger as discussed above. Thus, rather than selling the heat exchanger in its physical form, it may also be sold in the form of data controlling an additive manufacturing machine to form such a heat exchanger. A storage medium may be provided storing the data structure.

Figure 1:
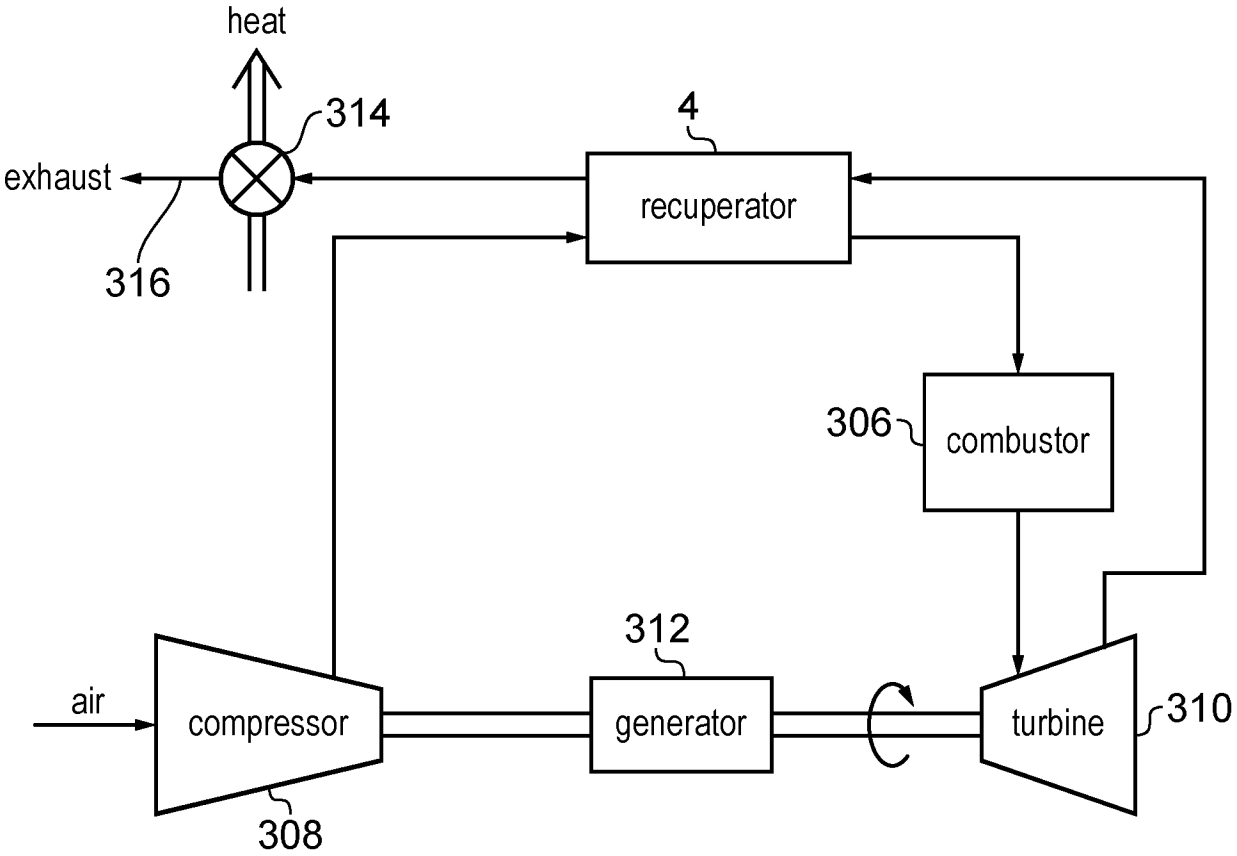

FIG. 1 schematically illustrates an example of a system 2 comprising a heat exchanger 4. In this example the system 2 comprises a micro turbine engine used for combined heat and power (CHP) for home energy supply. A combustor 306 combusts a fuel (e.g. gas). The intake air for the combustor is compressed by a compressor 308 which is driven by a turbine 310 driven by the exhaust gas from the combustor 306. The turbine and compressor 308 are mounted on a common shaft together with a generator 312 which generates electrical power based on the rotation of the turbine. The electrical power can be supplied as part of the electricity supply for home.

The exhaust gas from the combustor 306 having driven the turbine 310 is passed to the recuperator 4 which comprises a heat exchanger with alternating channels for the exchange of heat between first and second fluids. The heat in the exhaust gas is used to pre-heat the compressed air intake for the combustor so that the air is at a higher temperature upon entering the combustor and so the combustion efficiency of the combustor 306 can be improved. Having passed through the recuperator 4, the exhaust gas still contains some heat which can be recovered for example to heat the domestic water supply or central heating within the home at heating element 314, and then the exhaust gas is exhausted to the outside at vent 316. The combustor intake air entering the recuperator 4 is at higher pressure than the exhaust gas from the combustor 306 and turbine 310, since the intake air has been compressed by the compressor 308 and the exhaust gas has been expanded by the turbine 310.

Of course, it will be appreciated that FIG. 1 shows one use case for a heat exchanger, but the heat exchanger described above and below may also be used for many other engineering applications.

Figure 2:
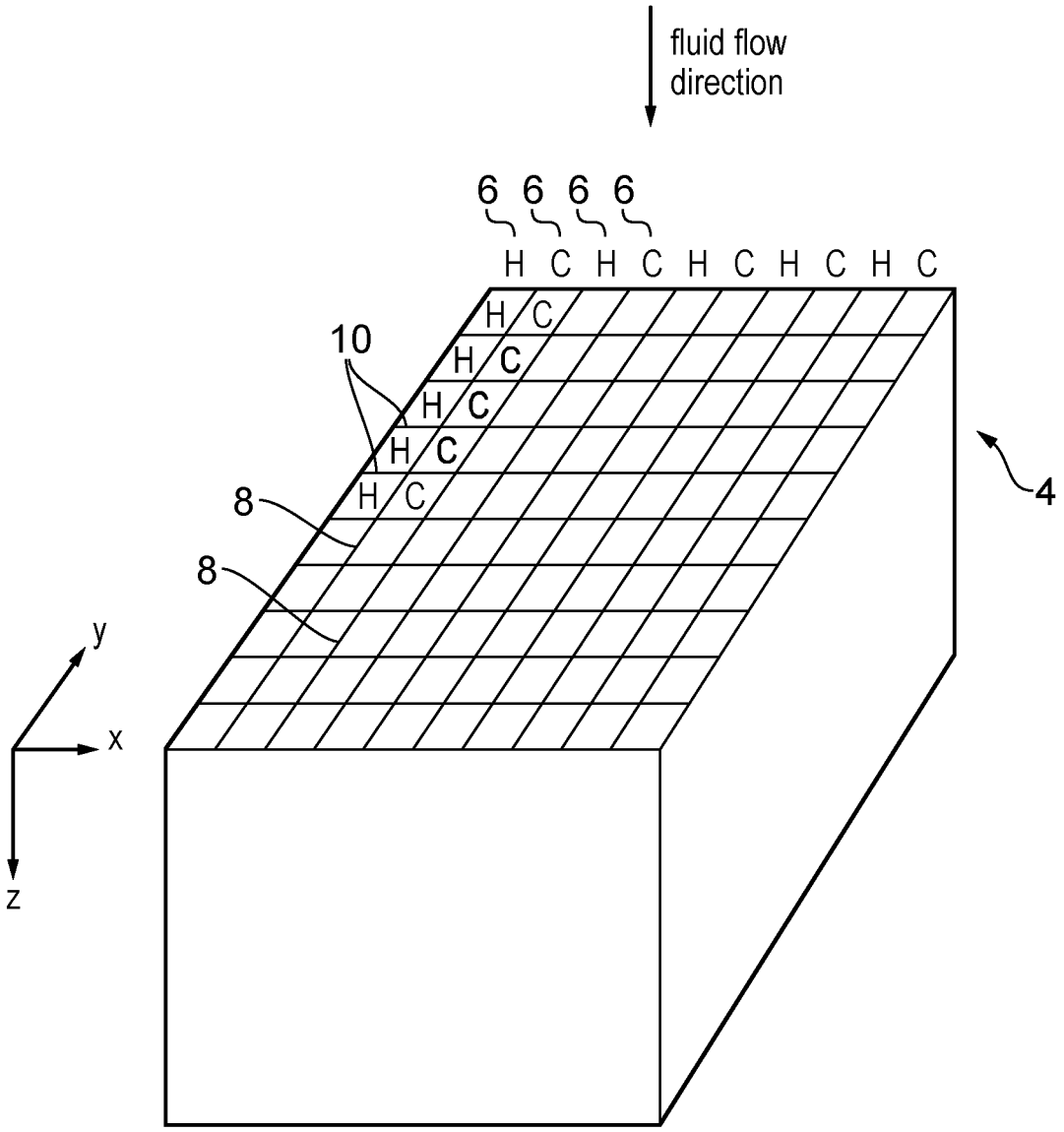
FIG. 2 shows an example of a heat exchanger comprising fluid flow channels.

FIG. 2 shows an example of the heat exchanger 4 in more detail. The heat exchanger includes a number of fluid flow channels 6 through which fluid can flow in the fluid flow direction illustrated at the top of FIG. 2. A number of alternating hot and cold channels are provided for the flow of hot fluid (first fluid) and cold fluid (second fluid) respectively. For example in the system of FIG. 1 the hot fluid may be the exhaust gas from the combustor 306 which has left the turbine 310 and the cold fluid may be the compressed intake air from the compressor 308 which is pre-heated using the exhaust gas heat. Manifolds are provided to distribute fluid from a hot inlet conduit or cold inlet conduit respectively, and split the fluid between the respective hot or cold channels as appropriate. The heat exchanger could be a parallel flow heat exchanger in which the hot and cold fluid flows in corresponding directions through the channels or could be a counter-flow heat exchanger in which the hot fluid flows in the opposite direction to the cold fluid.

In this example the hot channels and cold channels are separated by primary channel walls 8 which extend along the Y axis shown in FIG. 2. In addition, within each hot or cold channel a number of regions are internally sub divided by secondary surfaces 10 which divide different portions of the hot channel or different portions of the cold channel from one another. Although the primary mechanism of heat exchange is through the primary channel walls 8 between the hot and cold channels, the internal sub divisions within a hot channel or within a cold channel by the secondary surfaces 10 provides additional surfaces through which heat can be conducted to the primary walls 8. The secondary surfaces 10 could be further walls which extend along the full length of the fluid flow channel 6 in the fluid flow direction, or could be subdividing fins which only extend partially along less than the full length of the channel (e.g. see FIG. 5 below).

While FIG. 2 shows an example where the hot channels are aligned in a column and cold channels are aligned in a column, in other examples the hot and cold channels could be staggered or interleaved in a checkerboard pattern, so that each hot channel (other than the channels at the edge of the heat exchanger) is surrounded by cold channels on each side, and vice versa.

As described above, a primary surface separates two different fluids, such as a hot channel from a cold channel, whilst a secondary surface separates two channels containing the same fluid, for example where the two channels contain the hot fluid or the two channels contain the cold fluid. Due to the difference in fluid properties on either side of a primary surface, such as temperature and pressure, compared to a secondary surface, the primary surfaces are required to be stronger and more robust than the secondary surfaces. For example, primary surfaces may have a greater wall thickness than secondary surfaces.

As shown in FIG. 3 for at least some of the channels 6, the secondary heat exchanging surface 10 may be provided, along at least part of its length, with an undulating profile which has a surface profile which varies in a wave like pattern along a predetermined direction corresponding to the fluid flow direction (the Z axis in this example). In this context the surface profile of the surface refers to the position of the surface in the Y axis which is generally perpendicular to the X, Z plane of the surface. Hence, rather than being a flat surface, the secondary dividers 10 within channel 6 have a wiggly surface.

More particular, for each undulating section of the secondary heat exchanging surface 10, at a first edge E1 of the undulating section which is aligned with the predetermined direction (Z axis), the surface profile varies according to a first transverse wave 20 with a direction of travel corresponding to the predetermined direction. Similarly at a second edge E2 aligned with the predetermined direction, the profile varies according to a second transverse wave 22 with a direction travel that corresponds to the predetermined direction (Z axis, which in this example corresponds to the fluid flow direction). On the other hand, at an intermediate point I which lies between the first edge E1 and the second edge E2, the surface profile of the undulating surface section varies according to a third transverse wave 24 with a direction of travel corresponding to the predetermined direction.

In this example the first and second transverse waves 20, 22 are in phase and have the same frequency and amplitude so that the Y-position (profile) of the surface is the same at both edges E1 and E2 of the undulating surface section. On the other hand, in this example the third transverse wave 24 has the same frequency and amplitude as the first and second transverse waves but a different phase relationship. As the third transverse wave 24 is out of phase with the first and second transverse waves 20, 22, the crests and troughs of the wave occur at different positions along the Z axis (predetermined direction). Note that in order to show the relationship between the first, second and third transverse waves in a two dimensional diagram, the portion shown on the right hand side of FIG. 3 plots the first, second and third transverse waves side by side with E1, I and E2 arranged from left to right in the same way as the view shown in FIG. 3. However, while the Y axis is shown in the right hand part of FIG. 3 as extending along the plane of the page in order to enable a two dimensional representation, it will be appreciated that in reality if the view is such that E1, I and E2 are seen side by side as shown in FIG. 3, the Y axis would actually extend perpendicular to the page (into or out of the page) so that the crests and troughs of the ridges and valleys would actually be going in and out of the page.

As shown in FIG. 3, the effect of having the variation of the surface profile at the intermediate portion out of phase with the variation at the edges is that the surface provides a number of chevron-shaped ridges 26 and valleys 28 which point in a V-shape along the fluid flow direction in the Z axis. This can also be seen by the lines 29 joining the adjacent crest and troughs of the waves as shown in the right hand part of FIG. 3. When the heat exchanger 4 is in use then this has the effect that as fluid (gas or liquid) flows through the channel, the part of the fluid which sticks nearest the heat exchanging surface 10 has to flow over the ridges and this tends to cause re-circulation of the fluid towards the centre, with other parts of the fluid which are further away from the wall taking the place of the fluid which was previously at the ridge, and hence as the fluid passes along the length of the channel this mixes the fluid and reduces the likelihood that a given volume of fluid stays far away from the heat exchanging surfaces or along the length of the channel.

Figure 4:
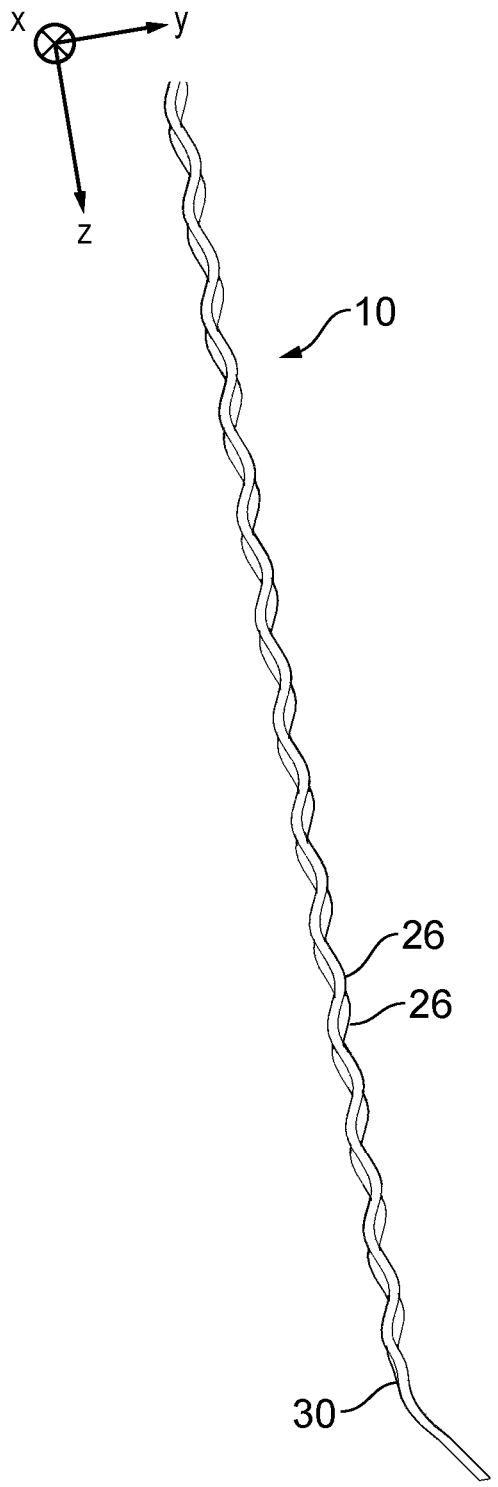
FIG. 4 shows a side view of the undulating surface section of the heat exchanging surface.

FIG. 4 shows another view of the undulating surface profile of the secondary heat exchanging surface 10 when viewed along the X axis in the Z-Y plane. From the side view it is clear how the peaks of the chevron-shaped ridges 26 occur at different positions along the Z axis at the edge of the chevrons compared to the centre of the chevrons at the intermediate points I, so that they provide the chevron shapes pointing along the predetermined fluid flow direction.

As shown in FIGS. 3 and 4, the secondary heat exchanging surface may include a bent portion 30 at one end which may direct the fluid around a turn at an angle. This can be useful for heat exchangers where the fluid needs to exit at a conduit oriented at a different orientation to the input flow. Hence the bent portion may guide the fluid around a corner to the outlet conduit for example. As shown in FIG. 3, at one end of the surface the surface may be formed with a V-shaped notch 32 extending inwards from the end of the surface. This can be useful because it allows the surface to be built by additive manufacture since it means that there is no overhang greater than a certain angle when an upper layer is built above a lower layer of material when being formed layer by layer in the additive manufacture process. Hence, the build direction for the surface can be in the opposite direction to the fluid flow direction in this particular example as illustrated in FIG. 3.

Figure 5:
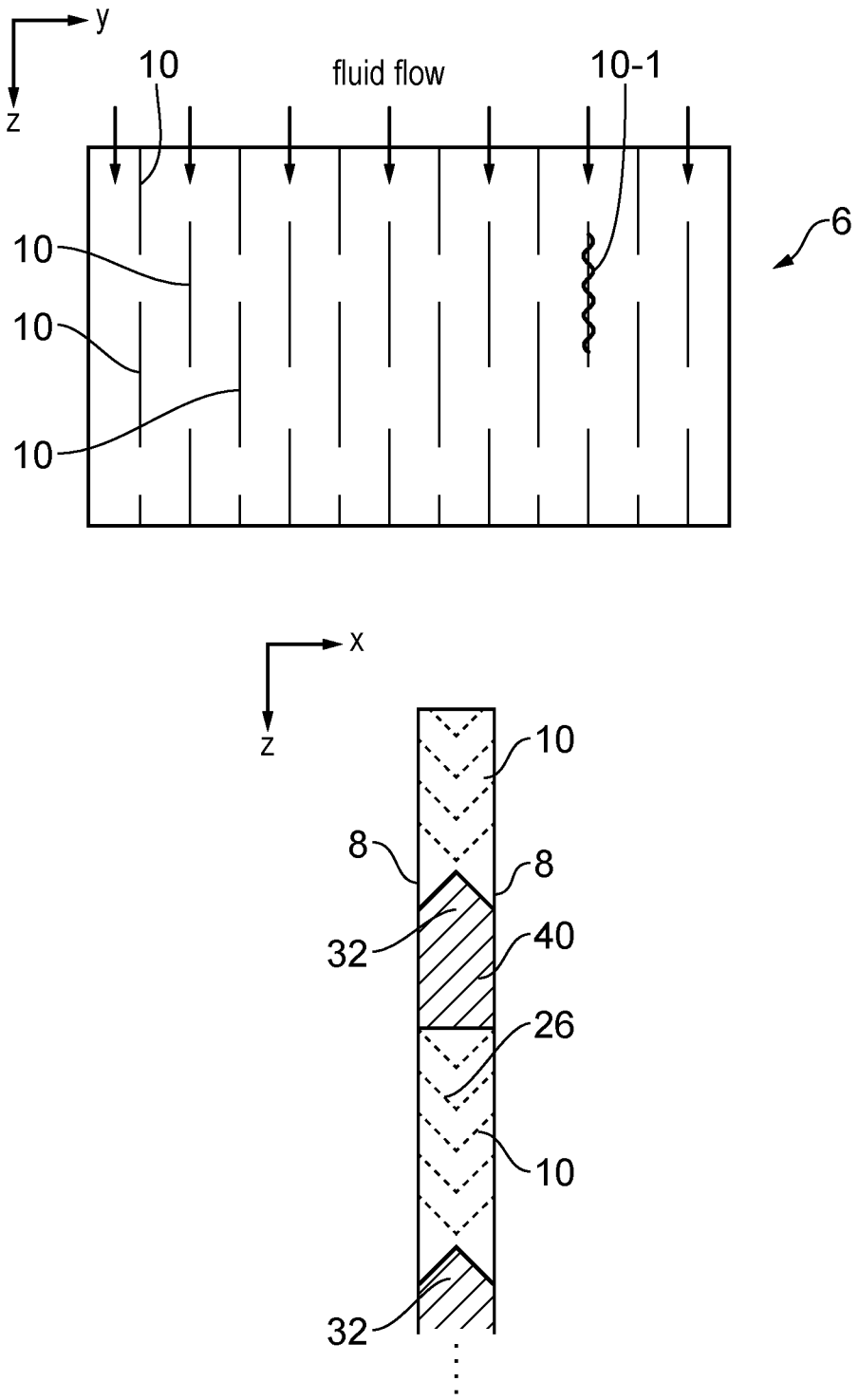
FIG. 5 shows an example where internal fins which internally sub-divide a heat exchanging channel comprise an undulating surface section.

As shown in FIG. 5, if the fluid flow channels 6 are viewed along the Y-Z plane then the secondary dividing surfaces 10 need not to be provided along the full length of the channel 6 but could be internal fins which extend only along part of the length to subdivide regions of a hot channel 6 or cold channel 6 as required. The positions of the fins could be staggered at different portions along the Y axis. Note that each of the internal fins could have the undulating profile as shown in FIG. 3 as showed for an example fin 10-1 in FIG. 5. Alternatively, only some of the fins could have the undulating section and other fins could be flat. As shown at the lower part of FIG. 5, when multiple fins are provided at different positions along the Z axis with a gap 40 between the fins 10, then by having the notch shape 32 at the base of each fin, this enables the fins to be made by additive manufacture since they bridge out from adjacent primary walls 8 of the channel. Since there is a V-shaped notch then the upper layers of the material being laid down need only extend beyond lower layers by a smaller angle for each successive layer until eventually they meet in the middle and then the full surface with chevron-shaped ridges 26 and valleys can be formed.

While FIG. 3 shows an example where the first and second transverse waves 20, 22 are identical, this is not essential and in other examples the second transverse wave 22 could have a different phase, amplitude and/or frequency to the first transverse wave 20. In this case there may be some difference or asymmetry in the chevron shapes.

Figure 6:
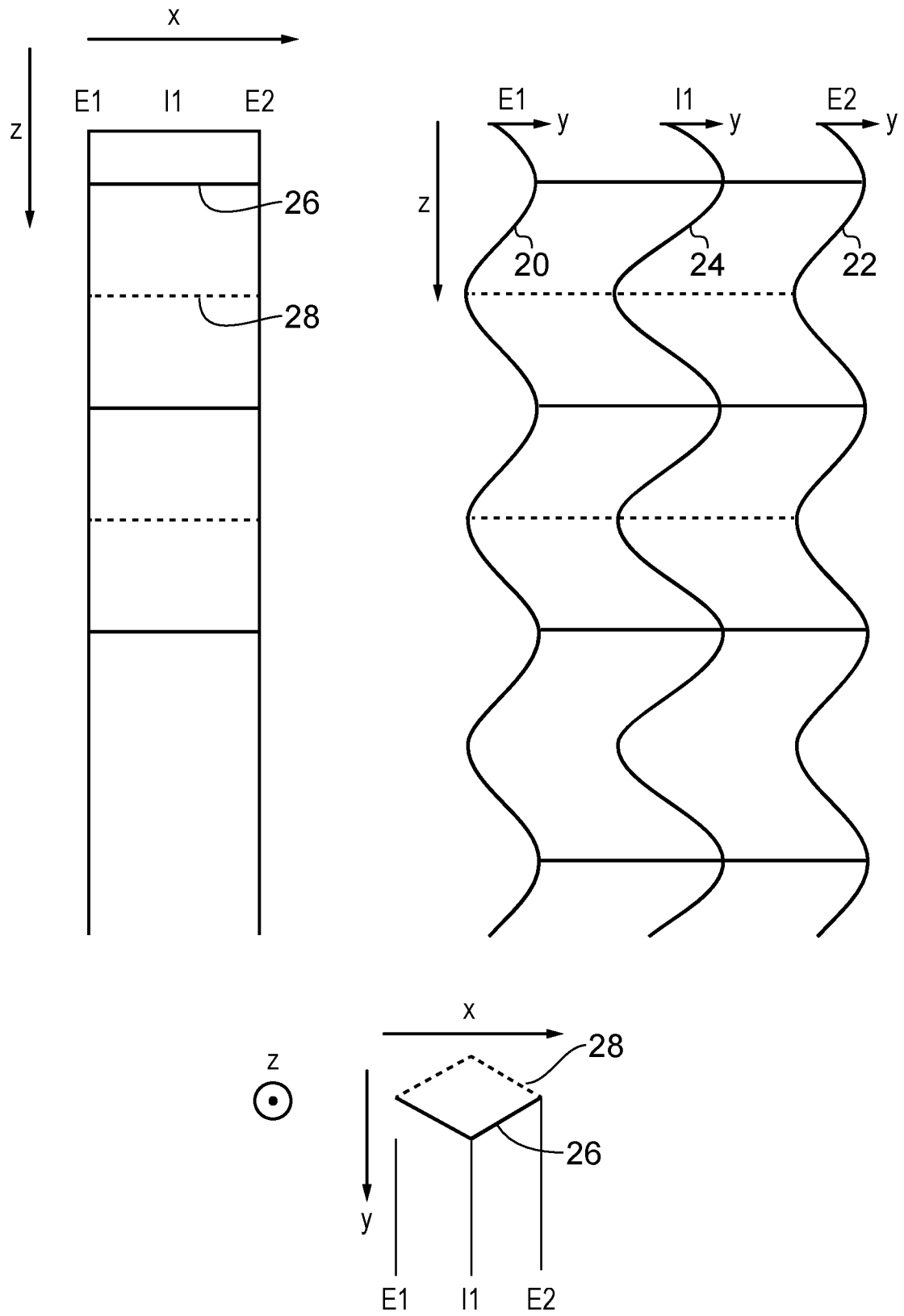
FIG. 6 shows an example where the undulating surface section has an intermediate portion which has a profile varying in a transverse wave which has a different amplitude to a wave corresponding to portions of the undulating surface section at the edges.

As shown in FIG. 6, in an alternative, the third transverse wave 24 may have a different amplitude so that its peaks and troughs are deeper or shallower than the peaks and troughs in the first and second transverse waves. In this case, rather than pointing along the Z axis, the chevron-shaped ridges 26 and valleys 28 may point in the Y axis as shown in the bottom diagram of FIG. 6. Hence, if viewed in the X-Z plane the ridges 26 and valleys may appear straight as the crests and troughs of the first, second and third transverse waves 20, 22, 24 are in phase in the Z direction, however when viewed from above in the X-Y plane as shown in the bottom of FIG. 6 then it can be seen that the chevrons are formed because the size of the peaks and troughs is larger at the intermediate point I1 of the surface than at the edges E1, E2. Again, this type of surface promotes mixing a fluid and hence better heat exchange. While in FIG. 6 the first and second waves are in phase with the third wave, in other examples the third wave may differ in both amplitude and phase, compared to the first and second waves.

Figure 7:
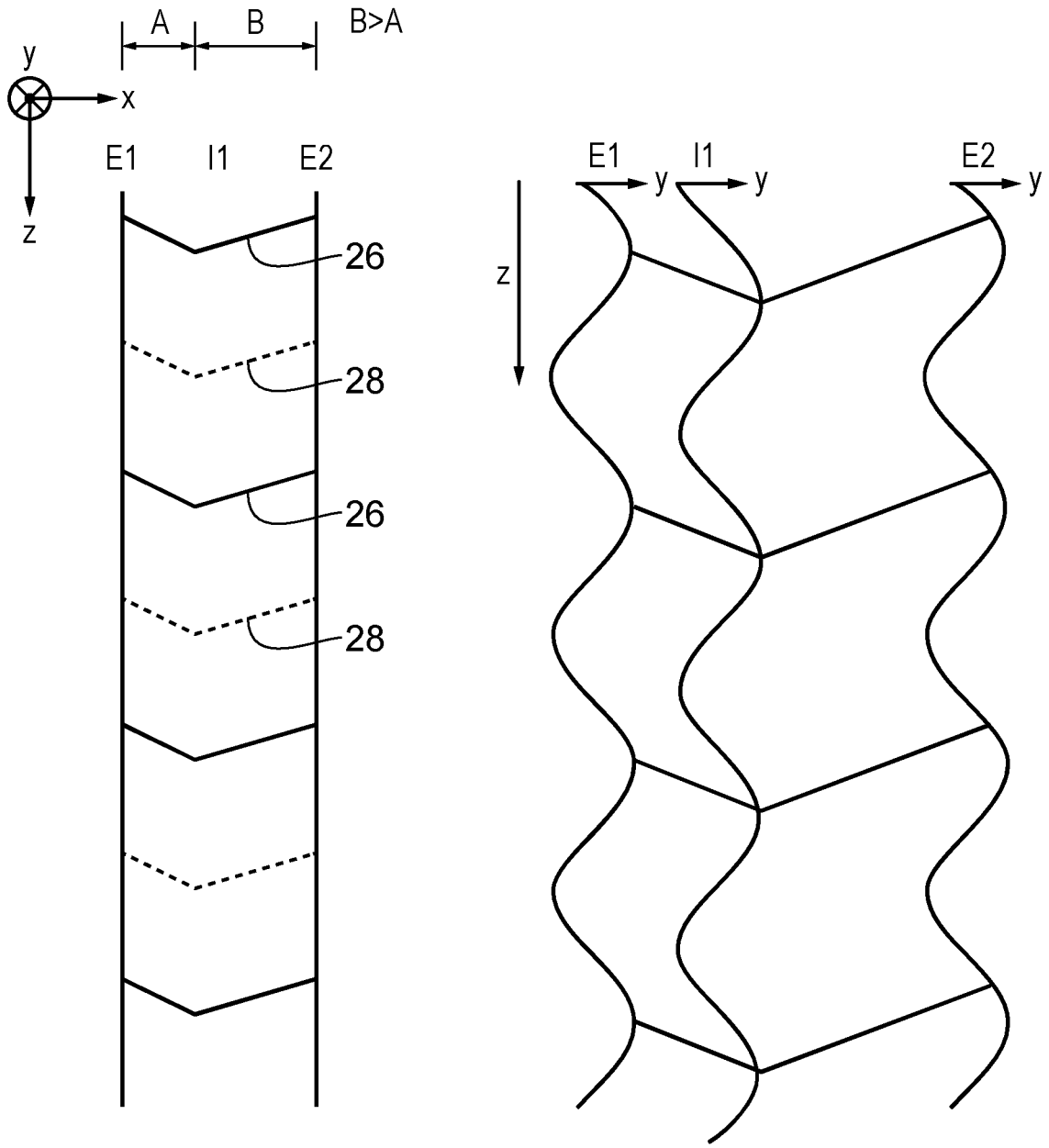
FIG. 7 shows an example in which the apex of chevron-shaped ridges and valleys of the undulating surface section lies closer to one edge than the other.

In the examples of FIGS. 3 and 6, the intermediate point I1 was halfway between the edges E1, E2, but this is not essential and FIG. 7 shows an example in which the intermediate point at which the apex of each chevron-shaped ridge or valley is formed lies closer to one edge E1 than the other edge E2.

Figure 8:
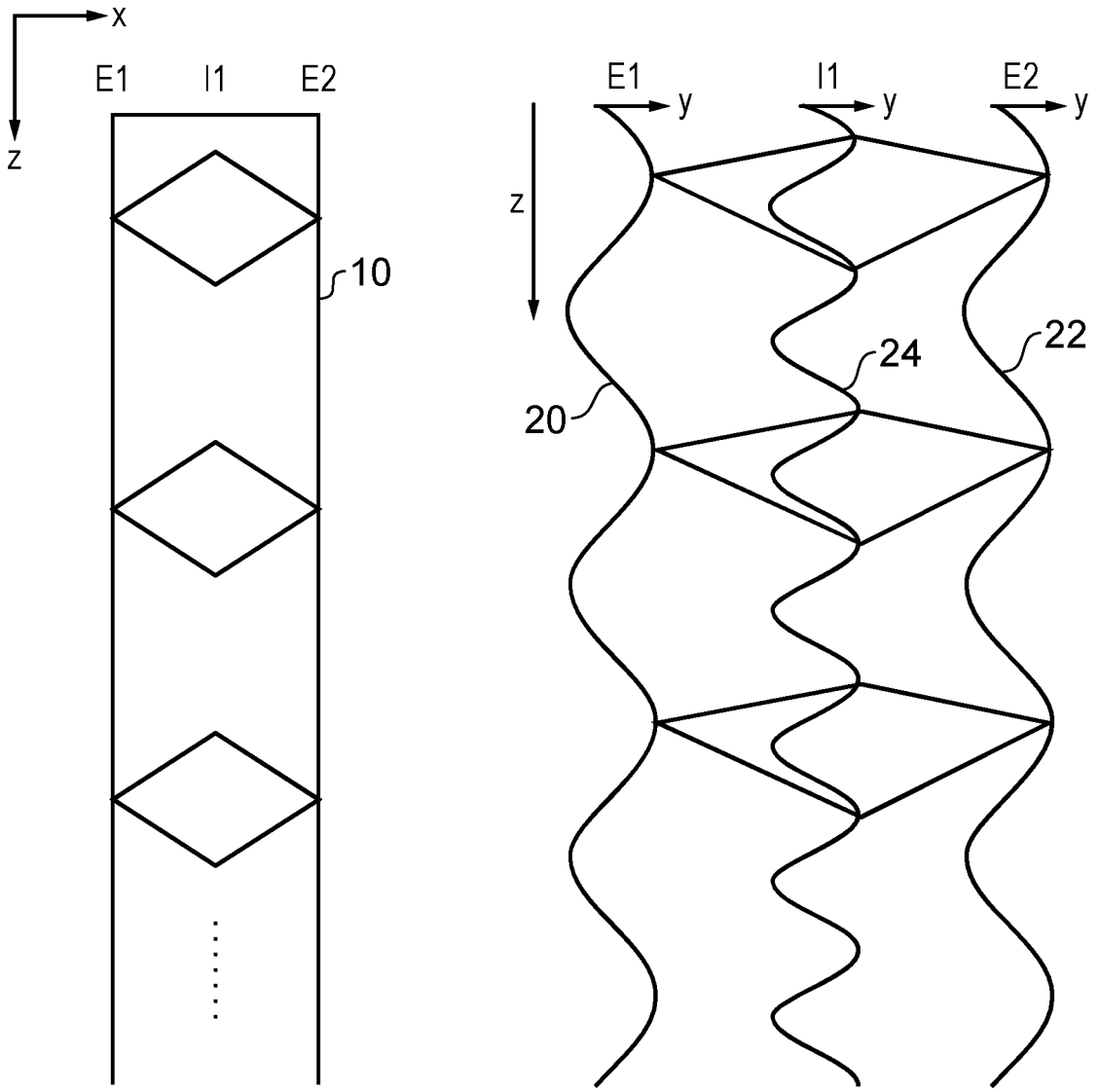
FIG. 8 shows an example where the third transverse wave at an intermediate point of the undulating surface section has a different frequency to the first and second transverse waves edges of the undulating surface section.

FIG. 8 shows another example in which the third transverse wave 24 has a different frequency to the first and second transverse waves 20, 22 and so in this case there are more crests and troughs at the intermediate point I1 than at the edges E1, E2 of the undulating surface section of the heat exchange surface 10. This may result in diamond-shaped ridges where two adjacent chevrons link up as shown in the left hand part of FIG. 8. Again this can provide greater mixing of fluid.

It is not essential for the entire surface of a given heat exchange surface 10 to have the wave-like undulating section as discussed above. In some cases only part of the secondary heat exchanging surfaces 10 may be provided with the wave-like surface and other parts may be flat.

Also, while the above example show cases where the undulating surface is in the secondary walls 10 of the heat exchanging channels (which divide different portions of the hot channels or different portions of the cold channels respectively), it is also possible to form the primary walls 8 which divide a hot channel from a cold channel with such an undulating surface section.

Figure 9:
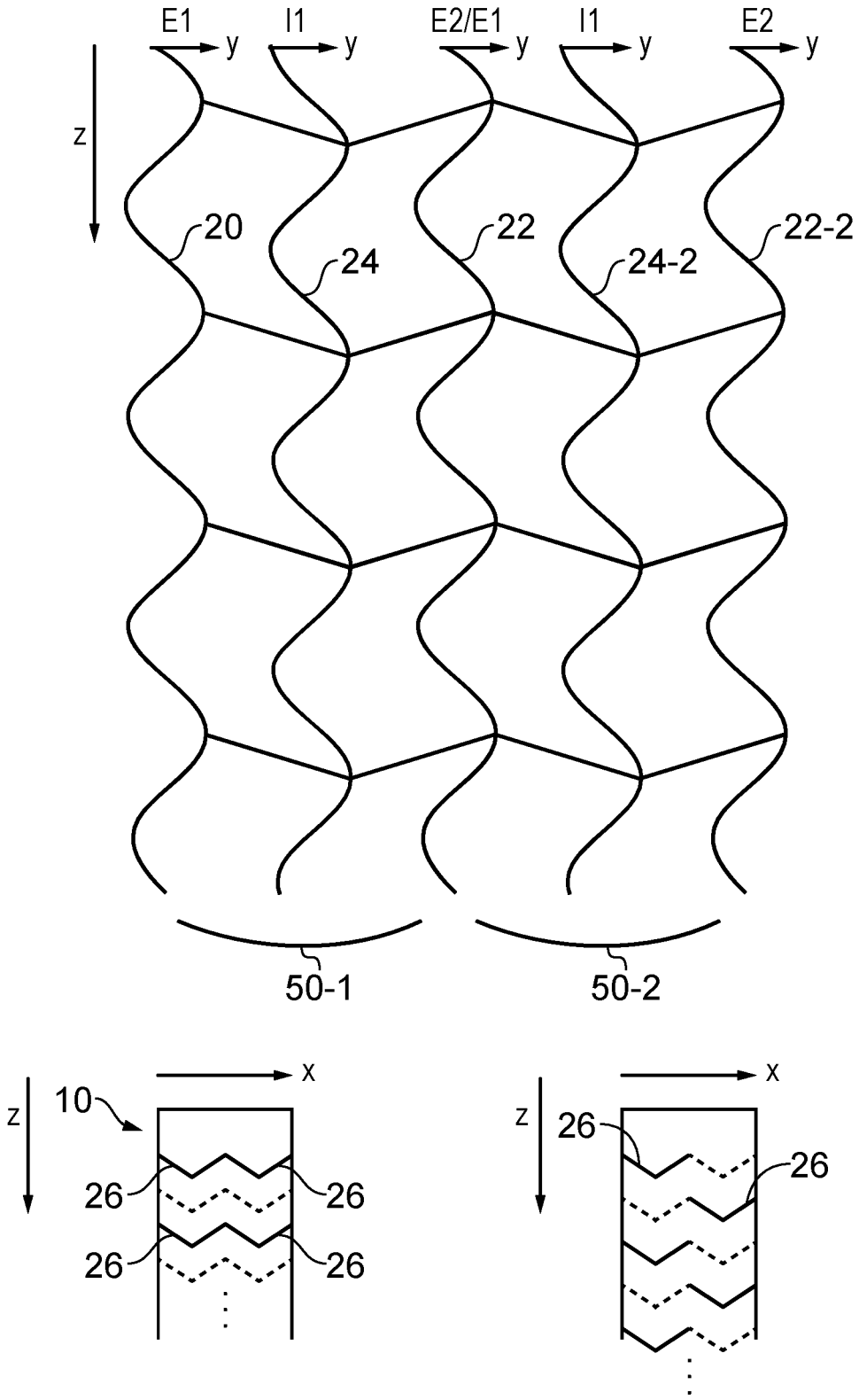
FIG. 9 shows an example where the heat exchanging surface includes multiple undulating surface sections arranged side by side.

Also, in the examples shown above the secondary wall surfaces 10 comprise a single undulating section with a single chevron across the width of the surface. However, as shown in FIG. 9 it is also possible to provide multiple undulating sections 50 side by side so that multiple chevron-shaped ridges 26 are formed across the width of the surface 10 as shown at the bottom of FIG. 9. Hence, in a first undulating section 50-1 the surface profile variation along the Z axis corresponds to first, second and third transverse waves 20, 22, 24 at the edges E1, E2 and intermediate point I1 respectively, in the second undulating section the first edge E1 essentially corresponds to the second edge E2 of the first undulating section and so the first transverse wave of the second undulating portion 50-2 is the same as the second transverse wave for the first undulating portion, and then further second and third transverse waves 22-2 and 24-2 are formed at the second edge E2 and intermediate I1 portion of the second undulating section 50-2. While in the example shown at the top of FIG. 9 and in the bottom left the second and third transverse waves 22-2, 24-2 are in phase with the second and third transverse waves 22, 24 of the first undulating section 50-1 respectively, so that the chevrons in the adjacent undulating sections line up to form W-shaped ridges, this is not essential and in an alternative the second undulating section could have its waves out of phase with those of the first undulating section so that the chevron-shaped ridges 26 are at different positions along the Z axis for the first and second undulating sections. It will be appreciated that more than two undulating sections could be placed side by side.

Also, whilst in the examples shown above the first, second and third transverse waves which form the undulating surface have a constant frequency, amplitude and phase along the length of the undulating surface in the predetermined direction, it is possible for one or more of the frequency, amplitude and phase of the waves to vary along the length of the surface. For example, the frequency of each of the first, second and third transverse waves may decrease along the Z axis, thereby increasing the wavelength of each of the first, second and third transverse waves along the Z axis. Alternatively, or in addition, the amplitude of the each of the first, second and third transverse waves may increase along the Z axis. In another example, the frequency of the first and second transverse waves may increase along the Z axis whilst the frequency of the third transverse wave remains constant along the Z axis. Alternatively, the frequency of the first and second transverse waves may increase along the Z axis at a greater rate than the frequency of the third transverse wave. In both cases, this reduces the internal angle of the chevron-shaped ridges or valleys along the Z axis, resulting in different chevron-shaped ridges or valleys along the Z axis.

Any changes in the frequency, amplitude and phase of the first, second and/or third transverse waves along the length of the undulating surface may account for changes in the properties of the fluid in the fluid flow channels. For example, if the fluid is expected to decelerate as it flows along the z axis, the frequency of the first, second and/or third transverse waves can be increased in the z axis to ensure the same degree of fluid mixing occurs along the length of the undulating surface. In this way, the undulating surface can be tuned to the expected flow properties of the fluid in the fluid flow channels. It will be appreciated that any combination of changes in frequency, amplitude and phase of the first, second and/or third transverse waves along the Z axis may be employed in order to achieve the desired undulations in the undulating surface.

Providing the undulating surface on a secondary surface instead of a primary surfaces makes the heat exchanger easier to build using additive manufacture whilst not adversely impact the structural rigidity of the primary surface. It also allows a different undulating surface pattern to be used on a secondary surface dividing two hot fluid channels compared to a secondary surface dividing two cold fluid channels, thereby allowing pattern of each undulating surface to be tailored to the fluid properties of the particular fluid on both sides of the secondary surface, such as temperature, pressure and mass flow.

The undulating surfaces may be arranged such that a given fluid channel has an undulating surface on more than one surface of the channel. In such a case, the transverse waves making up each undulating surface may have a frequency, amplitude and/or phase that ensures that the peaks and/or troughs of a wave on one undulating surface of the fluid channel do not contact the peaks and/or troughs of a wave on another undulating surface of the fluid channel.

Figure 10:
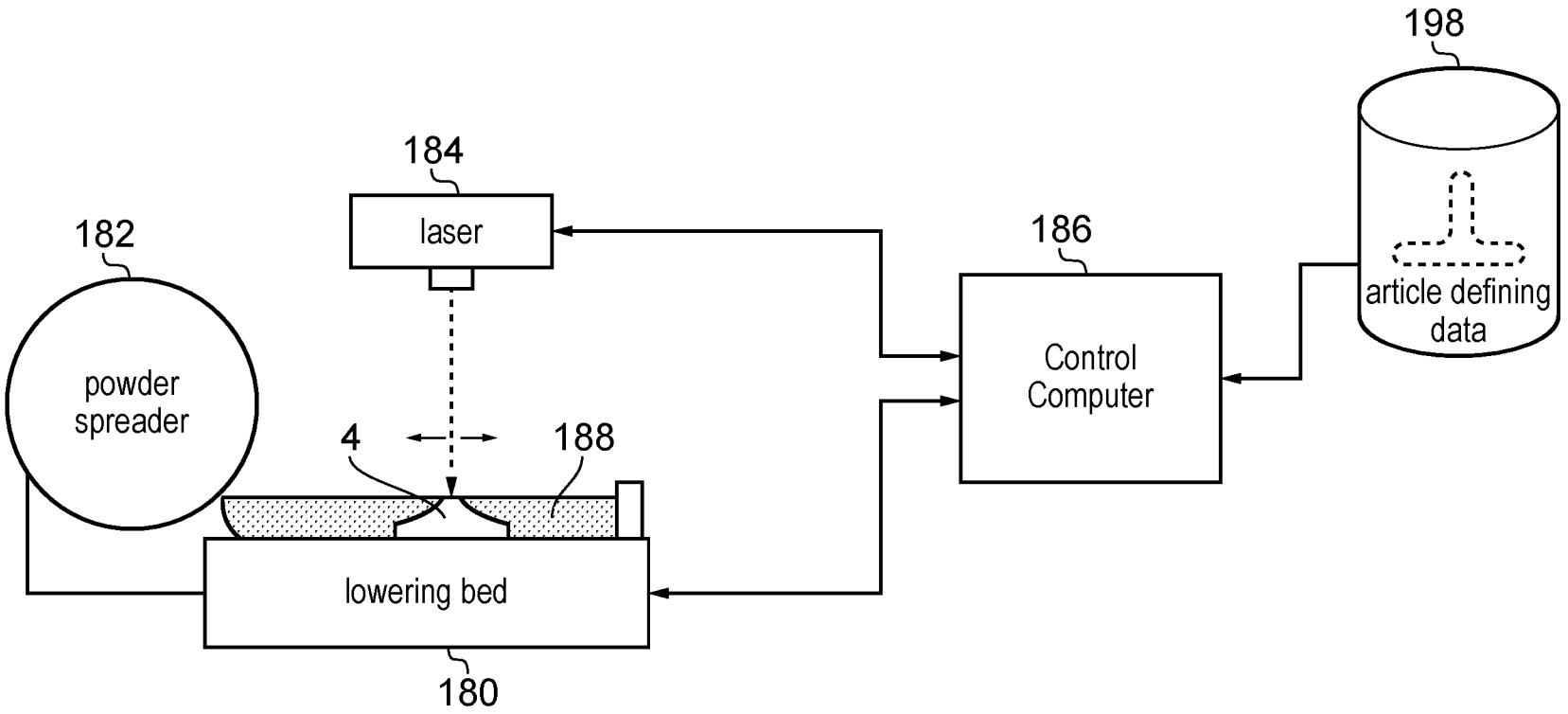
FIG. 10 illustrates one example of manufacturing equipment for manufacturing the heat exchanger by additive manufacture.

FIG. 10 schematically illustrates an example of additive manufacture. In this example, laser fused metal powder 188 is used to form an article 4 such as the heat exchanger described above. The article 4 is formed layer-by-layer upon a lowering powder bed 180 on top of which thin layers of metal power to be fused are spread by a powder spreader 182 prior to being melted (fused) via a scanning laser beam provided from a laser 184. The scanning of the laser beam via the laser 184, and the lowering of the bed 180, are computer controlled by a control computer 186. The control computer 186 is in turn controlled by a computer program (e.g. computer data defining the article 4 to be manufactured). This article defining data is stored upon a computer readable non-transitory medium 198. FIG. 10 illustrates one example of a machine which may be used to perform additive manufacture. Various other machines and additive manufacturing processes are also suitable for use in accordance with the present techniques, whereby a heat exchanger is manufactured with channels including a heat exchange surface with an undulating section as discussed above. For the specific design shown in FIG. 4, the build direction for additive manufacture in one example is illustrated by the arrow on the right hand side. By building the manifold portion starting with the layer closest to the entrance/exit of the heat exchanger core, it is possible to build the rest of the manifold portion without an upper layer needing to extend beyond a lower layer by an angle of more than 45 degrees from the vertical, and there is greater support for upper layers by lower layers, to make it more practical to make the component by additive manufacture.

Figure 11:
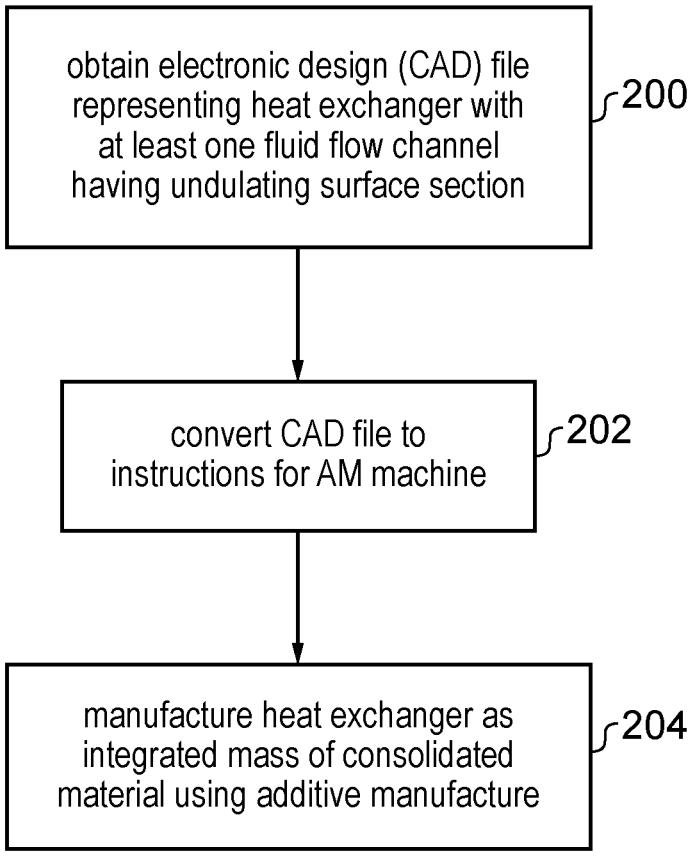
FIG. 11 is a flow diagram illustrating a method of manufacturing a heat exchanger.

FIG. 11 shows a method for manufacturing a heat exchanger. At step 200 a computer automated design (CAD) file is obtained. The CAD file provides a data structure which represents the design of a heat exchanger comprising fluid flow channels including a heat exchange surface with an undulating surface section as discussed above. For example, obtaining the CAD file at step 200 may comprise a designer generating a three-dimensional (3D) model of the heat exchanger from scratch, or could comprise reading an existing design from a recording medium or obtaining the CAD file via a network. The design file may represent the 3D geometry to be manufactured.

At step 202 the CAD file is converted to instructions for supplying to an additive manufacturing machine. The instructions control the additive manufacturing machine to deposit or form respective layers of material, which are built up layer by layer to form the overall heat exchanger. For example, the 3D design represented by the CAD file may be sliced into layers each providing a two-dimensional representation of the material to be formed in the corresponding layer.

At step 204 the converted instructions are supplied to an additive manufacturing machine which manufactures the heat exchanger as an integrated mass of consolidated material using additive manufacture. The heat exchanger can be made from various materials, e.g. metals or alloys, such as titanium or stainless steel, or a polymer for example. Various forms of additive manufacturing can be used, but in one example the additive manufacture uses selective laser melting.

FIGS. 12 to 14 show velocity streamline diagrams showing results of computational fluid dynamics (CFD) simulations of fluid flow through a channel with a heat exchange surface having the undulating surface section as shown in the example of FIG. 3. The shading used for the streamlines represents the velocity of fluid flow. The darkest lines in the region 400 nearest the apex of the chevron-shaped ridges represent the slowest fluid flow velocity. As can be seen in the two views shown in FIG. 12, the chevron-shaped ridges and valleys promotes cyclic recirculation of fluid from the edges of the channel towards the centre of the channel. As shown in the side view in FIG. 13, an effect of the recirculation is to disperse a curtain of slow-moving fluid which would otherwise be present at the boundaries of the channel. This is clear from the comparison between FIGS. 13 and 14. FIG. 13 shows simulation of fluid flowing through the channel with the fluid flow direction being aligned with the direction in which the chevrons point (so that the apex of the chevron-shaped ridges and valleys points towards the fluid outlet region of the channel, and points away from the fluid inlet region). In contrast, FIG. 14 shows simulation of a case where the fluid flows in the opposite direction relative to the chevrons (such that the chevron apex points towards the fluid inlet region). In the comparative simulation shown in FIG. 14, a curtain 402 of slow-moving fluid (indicated by the darker lines near the edge of the channel) remains near the side walls of the channel for substantially the full length of the portion of the channel shown in FIG. 14. A similar curtain would arise in a channel with flat surfaces. Such a curtain acts as a thermal boundary layer which tends to reduce the heat exchange efficiency of the channel, because it insulates hotter fluid in the centre of the channel from the walls of the channel through which heat can be conducted to adjacent channels. In contrast, as shown in FIG. 13 when the chevrons are aligned with the fluid flow so that the apex of each chevron points away from the fluid inlet region, the boundary curtain 402 is rapidly broken up by the cyclic recirculation induced by the chevron-shaped ridges in the undulating surface, to enable greater exchange of heat between the fluid in the channel and fluid in adjacent channels.

In one example, a heat exchanger comprises: a plurality of fluid flow channels; at least one of the fluid flow channels comprising at least one heat exchanging surface comprising at least one undulating surface section extending along at least part of a length of the channel; wherein for each undulating surface section: along a first edge of the undulating surface section aligned with a predetermined direction, a profile of the heat exchanging surface varies according to a first transverse wave with a direction of travel corresponding to the predetermined direction; along a second edge of the undulating surface section aligned with the predetermined direction, a profile of the heat exchanging surface varies according to a second transverse wave with a direction of travel corresponding to the predetermined direction; and at an intermediate portion of the undulating surface section lying between the first edge and the second edge, a profile of the heat exchanging surface varies according to a third transverse wave with a direction of travel corresponding to the predetermined direction; wherein said third transverse wave has at least one of different phase, different amplitude and different frequency to at least one of said first transverse wave and said second transverse wave, to provide one or more chevron-shaped ridges or valleys in the undulating surface section.

In one example, a method of manufacturing a heat exchanger is provided comprising: forming a plurality of fluid flow channels; at least one of the fluid flow channels comprising at least one heat exchanging surface comprising at least one undulating surface section extending along at least part of a length of the channel; wherein for each undulating surface section: along a first edge of the undulating surface section aligned with a predetermined direction, a profile of the heat exchanging surface varies according to a first transverse wave with a direction of travel corresponding to the predetermined direction; along a second edge of the undulating surface section aligned with the predetermined direction, a profile of the heat exchanging surface varies according to a second transverse wave with a direction of travel corresponding to the predetermined direction; and at an intermediate portion of the undulating surface section lying between the first edge and the second edge, a profile of the heat exchanging surface varies according to a third transverse wave with a direction of travel corresponding to the predetermined direction; wherein said third transverse wave has at least one of different phase, different amplitude and different frequency to at least one of said first transverse wave and said second transverse wave, to provide one or more chevron-shaped ridges or valleys in the undulating surface section.

Although illustrative embodiments of the invention have been described in detail herein with reference to the accompanying drawings, it is to be understood that the invention is not limited to those precise embodiments, and that various changes and modifications can be effected therein by one skilled in the art without departing from the scope of the invention as defined by the appended claims.

The invention claimed is:

1. A heat exchanger comprising:

a plurality of fluid flow channels;

at least one of the fluid flow channels comprising at least one heat exchanging surface comprising at least one undulating surface section extending along at least part of a length of the channel, wherein the at least one heat exchanging surface comprises a secondary surface of the heat exchanger;

wherein for each undulating surface section:

along a first edge of the undulating surface section aligned with a predetermined direction, a profile of the heat exchanging surface varies according to a first transverse wave with a direction of travel corresponding to the predetermined direction;

along a second edge of the undulating surface section aligned with the predetermined direction, a profile of the heat exchanging surface varies according to a second transverse wave with a direction of travel corresponding to the predetermined direction; and at an intermediate portion of the undulating surface section lying between the first edge and the second edge, a profile of the heat exchanging surface varies according to a third transverse wave with a direction of travel corresponding to the predetermined direction;

wherein said third transverse wave has at least a different phase from at least one of said first transverse wave and said second transverse wave, to provide one or more ridges or valleys extending across a width of the undulating surface section and pointing along the predetermined direction such that an apex of the ridges or valleys occurs at a different position along the predetermined direction at the intermediate portion of the undulating surface section than at the first and second edges.

2. The heat exchanger according to claim 1, wherein the predetermined direction corresponds to a fluid flow direction of fluid through the fluid flow channels.

3. The heat exchanger according to claim 1, wherein one or more of a frequency, amplitude and phase of at least one of the first transverse wave, the second transverse wave and the third transverse wave varies in the predetermined direction.

4. The heat exchanger according to claim 1, wherein the first transverse wave has the same phase, amplitude and frequency as the second transverse wave.

5. The heat exchanger according to claim 1, wherein the third transverse wave is out of phase with at least one of the first transverse wave and the second transverse wave.

6. The heat exchanger according to claim 1, wherein the third transverse wave has a different frequency to at least one of the first transverse wave and the second transverse wave.

7. The heat exchanger according to claim 1, wherein the third transverse wave has a different amplitude to at least one of the first transverse wave and the second transverse wave.

8. The heat exchanger according to claim 1, wherein the third transverse wave has a different waveform to at least one of the first transverse wave and the second transverse wave.

9. The heat exchanger according to claim 1, wherein an apex of the ridges or valleys lies half way between the first edge and the second edge.

10. The heat exchanger according to claim 1, wherein at least one of the ridges or valleys has an apex lying closer to one of the first edge and the second edge than the other.

11. The heat exchanger according to claim 1, wherein said at least one heat exchanging surface comprises a plurality of said undulating surface sections arranged side by side with the first edge of one undulating surface section adjacent to the second edge of another undulating surface section.

12. The heat exchanger according to claim 1, wherein said at least one heat exchanging surface has a substantially constant thickness in said at least one undulating surface section.

13. The heat exchanger according to claim 1, wherein said at least one heat exchanging surface comprises a wall of the at least one fluid flow channel.

14. The heat exchanger according to claim 1, wherein said at least one heat exchanging surface comprises an internal fin within the at least one fluid flow channel.

15. The heat exchanger according to claim 14, wherein said internal fin extends along less than a full length of the heat exchanging channel in the predetermined direction.

16. The heat exchanger according to claim 1, wherein the heat exchanger comprises an integrated mass of consolidated material.

17. The heat exchanger according to claim 1, comprising at least two heat exchanging surfaces, wherein the undulating surface on a first of the at least two heat exchanging surfaces is different to an undulating surface on a second of the at least two heat exchanging surfaces.

18. A system comprising:

a combustor to generate heat by combusting a fuel; and a recuperator to recover heat from the exhaust gas output by the combustor;

wherein the recuperator comprises the heat exchanger according to claim 1.

19. A method of manufacturing the heat exchanger according to claim 1, comprising forming the plurality of fluid flow channels.

20. The method of claim 19, wherein the heat exchanger is made by additive manufacture.

21. A non-transitory, storage medium storing computer-readable data structure representing a design of a heat exchanger according to claim 1.

* * * * *